US007374521B2

(12) United States Patent
Wang

(10) Patent No.: US 7,374,521 B2
(45) **Date of Patent: *May 20, 2008**

(54) POWER DRIVEN TILTING INVERSION EXERCISER

(76) Inventor: Lo Pin Wang, 16F-2, No. 62, Sec. 2, Chongder 2nd Road, Beitun Chu, Taichung 40652 (TW)

( * ) Notice: Subject to any disclaimer, the term of this patent is extended or adjusted under 35 U.S.C. 154(b) by 150 days.

This patent is subject to a terminal disclaimer.

(21) Appl. No.: 11/329,515

(22) Filed: Jan. 11, 2006

(65) Prior Publication Data

US 2007/0161477 A1 Jul. 12, 2007

(51) Int. Cl.
*A63B 26/00* (2006.01)

(52) U.S. Cl. ..... 482/145; 482/144

(58) Field of Classification Search ..... 482/144–147
See application file for complete search history.

(56) References Cited

U.S. PATENT DOCUMENTS 3,589,358 A * 6/1971 Megal ..... 606/244
5,044,358 A 9/1991 Morin ..... 128/71
6,030,325 A * 2/2000 Ottoson et al. ..... 482/144
7,118,518 B1 * 10/2006 Teeter ..... 482/144
7,125,372 B1 * 10/2006 Teeter et al. ..... 482/144

* cited by examiner

*Primary Examiner*—Lori Amerson
(74) *Attorney, Agent, or Firm*—Charles E. Baxley

(57) ABSTRACT

A tilting inversion exerciser includes a table rotatably supported on a supporting stand with a pivot axle and a power actuating foot retaining device attached to the table for being powered and actuated to clamp and to retain ankle portions of the user to the table without being operated manually by the user. The table includes two fixed foot supports for supporting the feet of the user, a tube is attached to the table, a stem is slidably attached to the tube and has two foot anchor members movable to clamp the feet of the user to the table. A motorized and threaded coupling device may move and adjust the stem relative to the tube. The table includes a hand grip for supporting an operating device.

18 Claims, 10 Drawing Sheets

POWER DRIVEN TILTING INVERSION EXERCISER

BACKGROUND OF THE INVENTION

1. Field of the Invention

The present invention relates to a tilting inversion exerciser, and more particularly to a tilting inversion exerciser having a power driving device for rotating the tilting inversion exerciser relative to the supporting stand, and having a power rotating ankle holder or foot retaining device for detachably securing the ankle portions of the user to the table of the tilting inversion exerciser.

2. Description of the Prior Art

Typical tilting inversion exercisers comprise a base or table pivotally or rotatably supported on a lower support stand, for supporting a user thereon, and for allowing the user to tilt or to incline the table relative to the lower support, in order to conduct the typical tilting inversion exercises, and comprise an ankle holder or foot retaining device attached to the table for detachably securing the ankle portions of the user to the table of the tilting inversion exerciser.

For example, U.S. Pat. No. 5,044,358 to Morin discloses one of the typical rotatable treatment benches also comprising a base or table pivotally or rotatably supported on a lower support, and a manually operated locking device is pivotally attached to a foot rest for being rotated relative to the foot rest to clamp and to retain the feet of the user to the base or table.

However, the locking device or ankle holder or foot retaining device is required to be operated manually, but may not be operated by power driving apparatuses. It will be difficult for some of the users to bend over their bodies and to reach and to manually operate the locking device when the user has lain on the table of the inversion exercises.

The other typical tilting inversion exercisers or benches may comprise a spring-biasing member for clamping and retaining the feet of the user to the base or table. However, the spring-biasing member may not solidly clamp and secure the feet of the user to the base or table and the feet of the user may have a good chance to be disengaged from the base or table particularly when the base or table is inverted.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including a power rotating device for rotating the tilting inversion exerciser relative to the supporting stand and for allowing the table to be rotated or tilted relative to the lower support to a vertical position relative to the lower support and the ground, and for allowing the user to conduct the inversion exercises.

The other objective of the present invention is to provide a tilting inversion exerciser including a power rotating ankle holder or foot retaining device for being powered to grasp and retain or to detachably secure the ankle portions of the user to the tilting inversion exerciser.

In accordance with one aspect of the invention, there is provided a tilting inversion exerciser comprising a supporting stand, a table rotatably supported on the supporting stand with a pivot axle for supporting a user on the table, and a power actuating foot retaining device attached to the table for being powered and actuated to clamp and to retain ankle portions of the user to the table.

The table includes two fixed foot supports for supporting the feet of the user, the power actuating foot retaining device includes a tube attached to the table, a stem slidably attached to the tube, two foot anchor members attached to the stem and movable toward and away from the fixed foot supports for clamping and retaining the feet of the user to the table, and a moving or adjusting device may be used for moving the foot anchor members relative to the fixed foot supports.

The moving device includes a threaded shank rotatably disposed in the tube, and a threaded member secured in the stem and threaded with the threaded shank for allowing the threaded member and the stem to be moved and adjusted relative to the tube by the threaded shank.

The moving device includes a motor coupled to the threaded shank for rotating and driving the threaded shank. The table includes a control device having a central processor unit, and a foot operating unit coupled to the central processor unit and coupled to the motor for operating the motor to move the stem relative to the tube.

The foot operating unit includes a detecting circuit coupled to the central processor unit and coupled to the motor for detecting whether the feet of the user have been safely or suitably clamped between the foot anchor members of the stem and the fixed foot supports or not.

The foot retaining device includes an extension extended from the table for supporting the tube and the fixed foot supports. The table includes a foot pedal attached to the extension for supporting the feet of the user.

The table includes a motor coupled to the pivot axle for rotating the table relative to the supporting stand. The table includes a reduction gearing coupled to the motor and engaged with the pivot axle to drive and to rotate the table relative to the stand with the pivot axle.

The control device includes a table operating unit coupled to the central processor unit and coupled to the motor for operating the motor to rotate the table relative to the supporting stand. The table operating unit includes an operating circuit coupled to the central processor unit and coupled to the motor.

The table operating unit includes at least one sensor for detecting a position of the table. The control device includes an operating device having an entering device coupled to the central processor unit for operating the control device.

The operating device includes a buzzer for generating a warning sound. The operating device includes at least one indicating light for generating indicating lights. The table includes at least one hand grip for supporting the operating device.

The control device includes a power supply device coupled to the central processor unit. The power supply device includes a battery, and a detecting circuit coupled to the battery for detecting an electric power of the battery.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
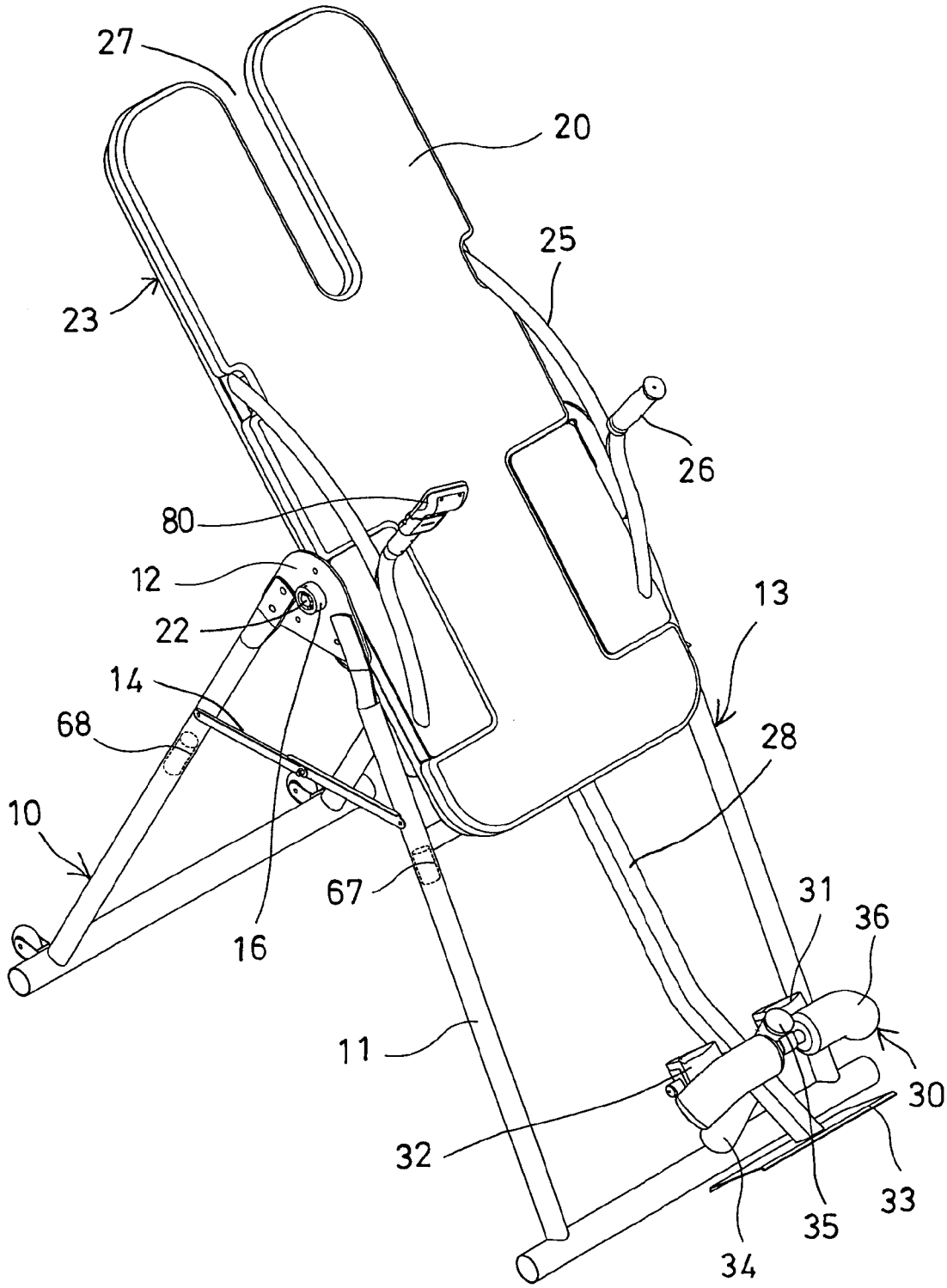
FIG. 1 is an upper perspective view of a tilting inversion exerciser in accordance with the present invention.
Figure 2:
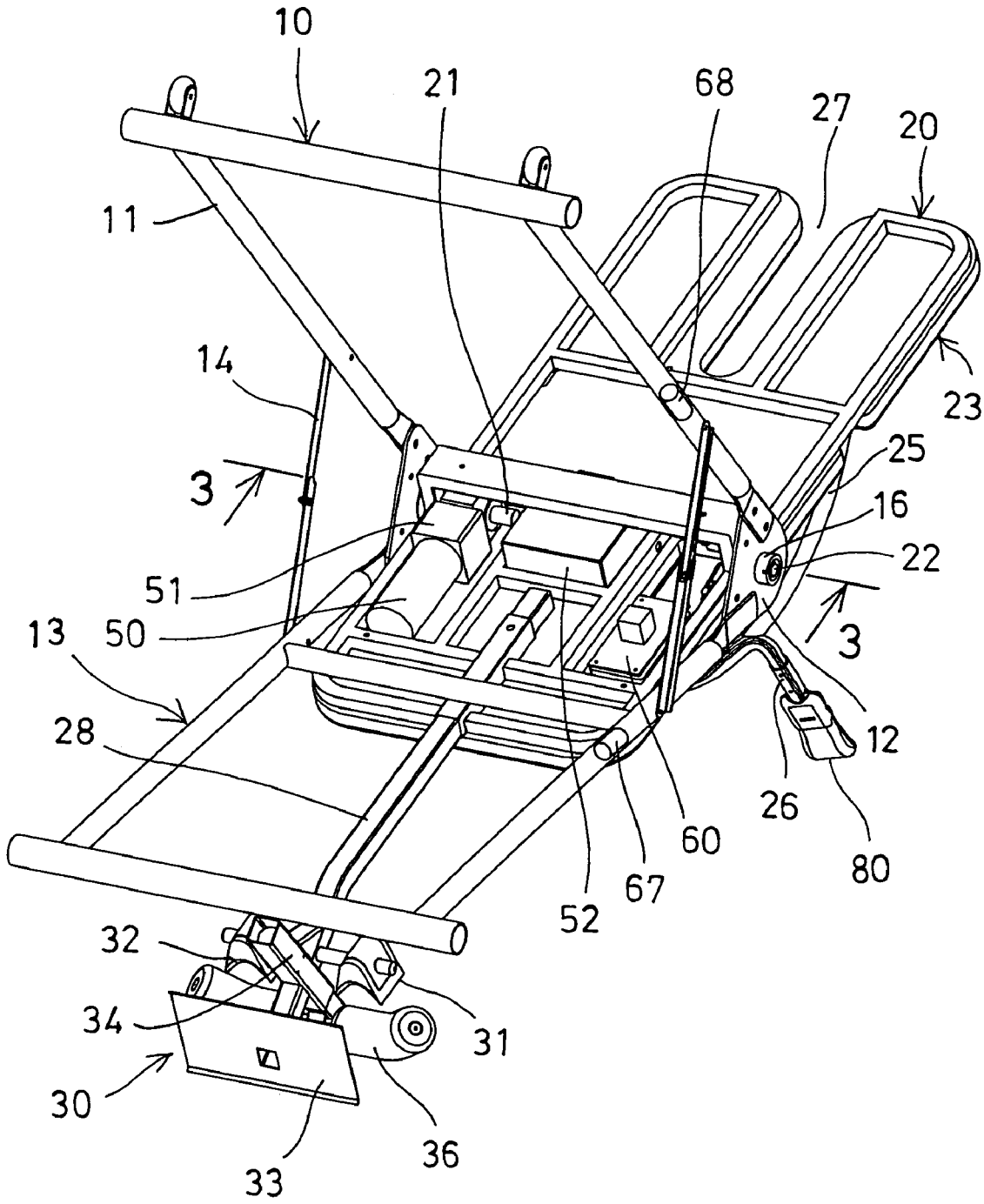
FIG. 2 is a bottom perspective view of the tilting inversion exerciser.
Figure 3:
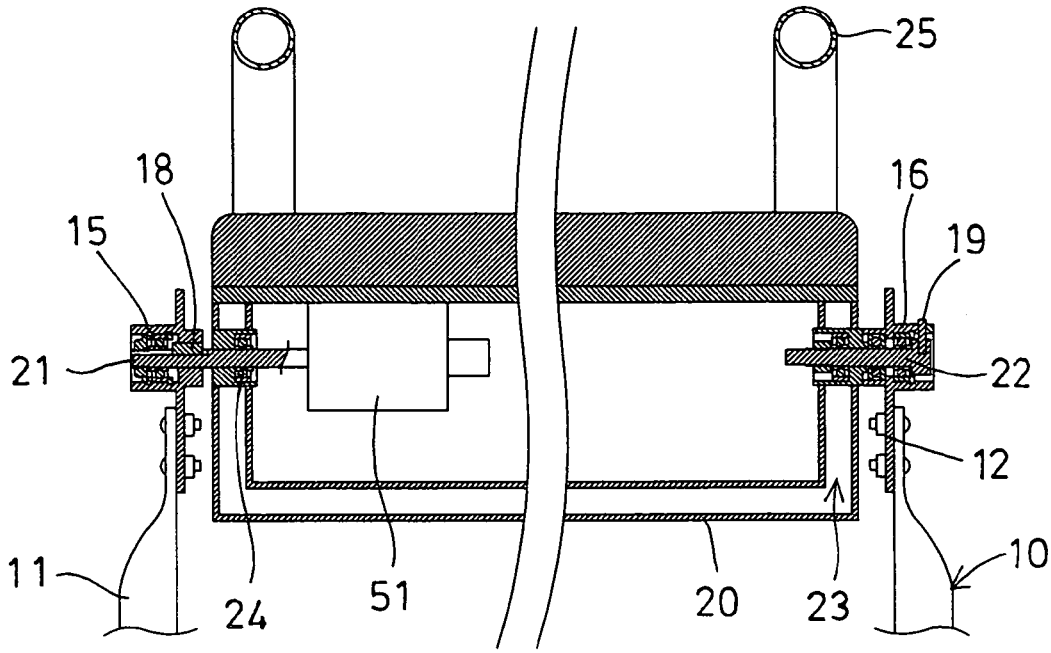
FIG. 3 is a partial cross sectional view of the tilting inversion exerciser, taken along lines 3-3 of FIG. 2.
Figure 7:
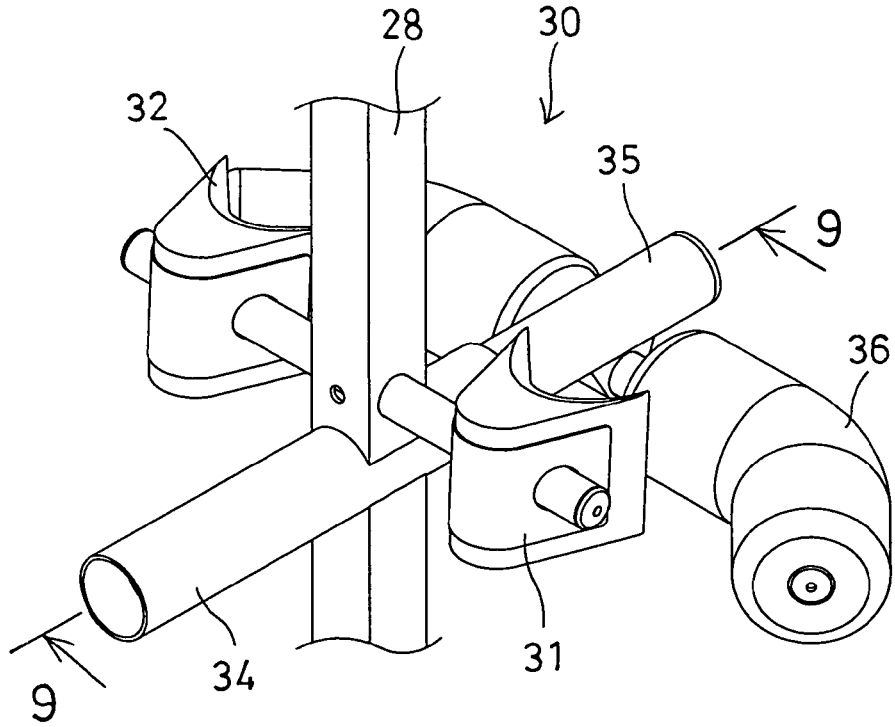
FIG. 7 is an enlarged partial perspective view of the tilting inversion exerciser.
Figure 4:
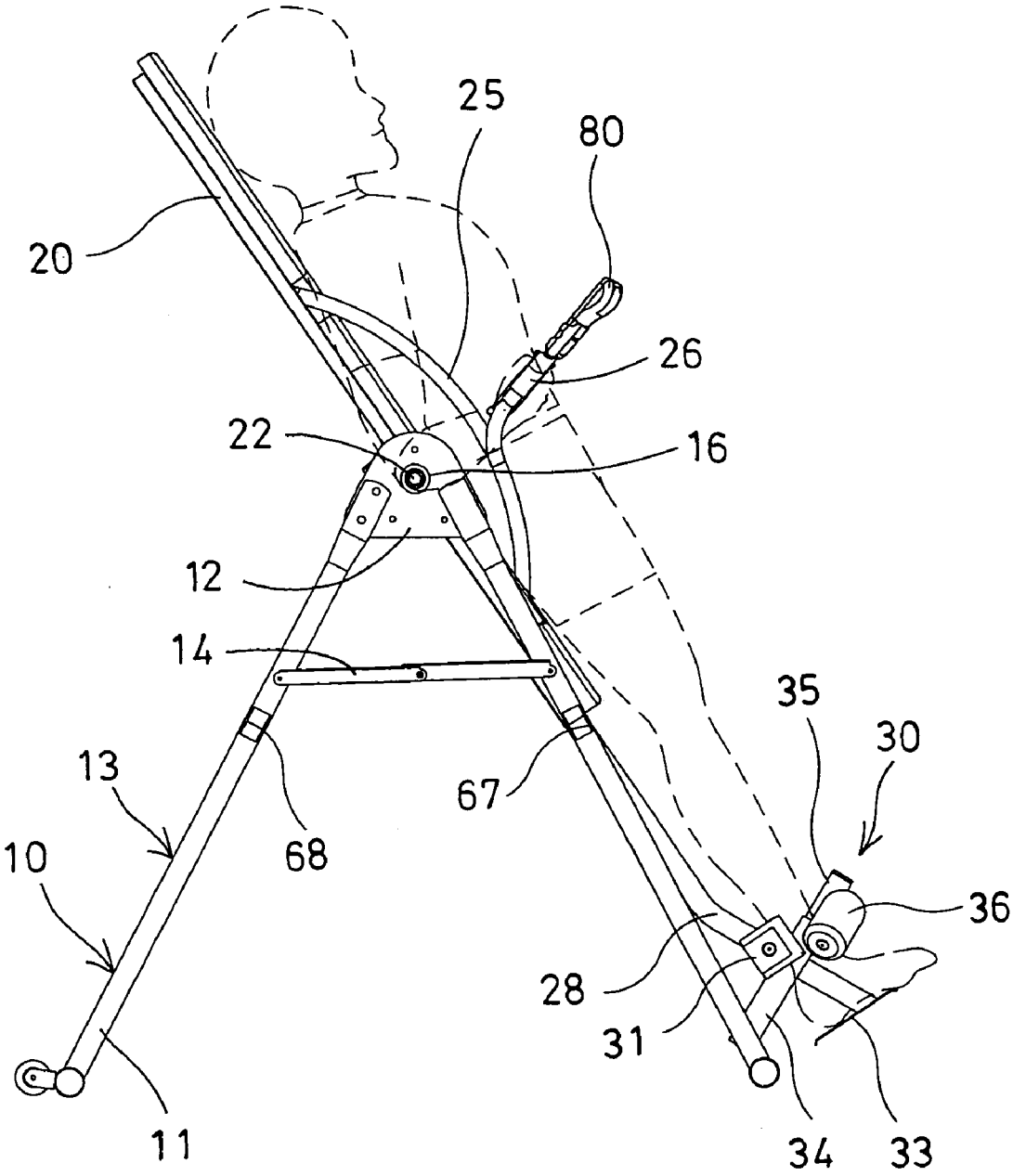
FIG. 4 is a side plan schematic view of the tilting inversion exerciser.
Figure 5:
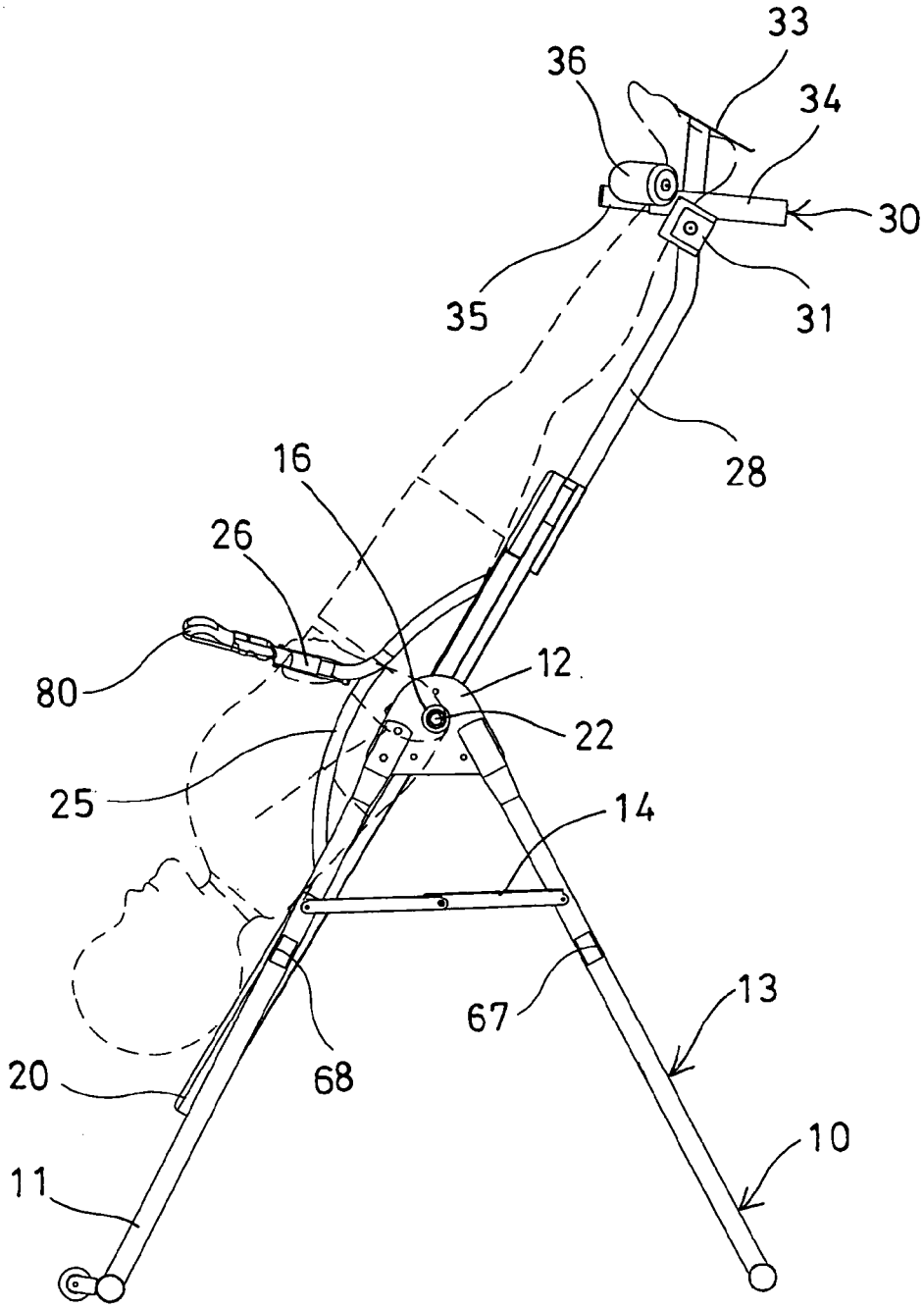
FIG. 5 is a side plan schematic view similar to FIG. 4, illustrating the operation of the tilting inversion exerciser.

Referring to the drawings, and initially to FIGS. 1-3, a tilting inversion exerciser in accordance with the present invention comprises a lower supporting stand 10 for pivotally or rotatably supporting a base or table 20 thereon, and for supporting a user on the table 20, the lower supporting stand 10 includes such as two pairs of legs 11 having upper ends pivotally coupled together with two apex plates 12, so as to form two inverted V-shaped or A-shaped frames 13. The table 20 may be pivotally or rotatably attached to and supported on the apex plates 12 of the lower supporting stand 10 with such as pivot axles 21, 22, best shown in FIG. 3.

The frames 13 may each include a foldable link 14 coupled between the legs 11, to retain the legs 11 in an open or working position as shown in FIGS. 1-2, 4-5, and 11-12. The links 14 are also foldable for allowing the legs 11 to be folded relative to the apex plates 12 to a folding or receiving position (not shown). The foldable stand 10 is typical and will not be described in further details. As also best shown in FIG. 3, the apex plates 12 each includes a hub 15, 16 disposed or provided thereon for supporting the pivot axles 21, 22, and the pivot axles 21, 22 may be secured to the hubs 15, 16 with one or more keys 18, lock pins 19 or the like, for preventing the pivot axles 21, 22 from being rotated relative to the hubs 15, 16 and the apex plates 12.

As also shown in FIG. 3, the table 20 includes two opposite side edges 23 pivotally or rotatably attached to and supported on the pivot axles 21, 22 of the apex plates 12 of the lower supporting stand 10 with such as bearings 24, for allowing the table 20 to be rotated relative to the apex plates 12 and the lower supporting stand 10 relative to the pivot axles 21, 22. The table 20 may further include one or more handles 25 disposed thereon (FIGS. 1-5 and 11-12) for being grasped by the users, or for retaining the users on the table 20, or the like, and may further include one or more, such as two hand grips 26 disposed thereon, and directly extended from the table 20, or indirectly extended from the handles 25 respectively, for being grasped by the users (FIGS. 4-5, 11-12).

The table 20 may further include an opening 27 formed in one end or upper portion thereof, for receiving the front portion of the head of the user. The table 20 includes an extension 28, such as an adjustable extension 28 attached or coupled or extended from the other end or lower portion thereof for supporting an ankle holder or foot retaining device 30 and for holding or retaining or positioning the feet of the users to the table 20. The extension 28 may be extended or adjusted relative to the table 20 for moving or adjusting the foot retaining device 30 toward or away from the table 20, according to the height of the users, for example.

As shown in FIGS. 1-2, 4-5 and 7-12, the foot retaining device 30 includes two fixed foot supports 31 attached to the extension 28 and the fixed foot supports 31 each includes a curved recess or soft pad 32 attached thereto to comfortably support the feet of the user, such as the ankle portions of the users (FIGS. 4-5 and 11-12). The foot retaining device 30 further includes a foot pedal 33 attached to the free end of the extension 28 to further stably support the feet of the user. A cylindrical housing or tube 34 is secured to or extended from or attached to the extension 28 of the table 20 and preferably inclined or perpendicular to the extension 28 for slidably or adjustably receiving or engaging a stem 35 therein, best shown in FIGS. 7-10.

The foot retaining device 30 includes two foot anchor members 36 attached to the stem 35 and movable toward and away from the fixed foot supports 31 of the extension 28 by the stem 35, for clamping or retaining the feet of the user to the extension 28, and for preventing the feet of the user from being disengaged from the extension 28. The foot anchor members 36 of the stem 35 may thus be defined or acted as movable foot anchor members 36 to selectively clamping the feet of the user together with the fixed foot supports 31 of the extension 28. The foot retaining device 30 further includes a moving or actuating means or device 37, such as a motor 37 attached or engaged or secured in the tube 34 and provided for moving the stem 35 and the foot anchor members 36 to clamp the feet of the user.

For example, a bolt or threaded shank 38 is coupled to a spindle 39 of the motor 37 and rotatably received or disposed in the tube 34 with one or more bearings 40 for allowing the threaded shank 38 to be driven or rotated relative to the tube 34 by the motor 37. A nut or threaded member 41 may be disposed and secured in the stem 35 and threaded with the threaded shank 38 for allowing the threaded member 41 and thus the stem 35 to be moved toward or away from the motor 37 or to be adjusted relative to the tube 34, in order to move the stem 35 and the foot anchor members 36 to selectively clamp the feet of the user.

As shown in FIG. 2, a driving device 50, such as a motor 50 is attached to the table 20 and includes a coupling or transmission device or reduction gearing 51 coupled to the motor 50 and engaged with one of the axles 21 (FIGS. 2-3), in order to drive or to rotate the table 20 relative to the stand 10 about or relative to the pivot axles 21, 22. It is preferable that the table 20 may be rotated or driven by the motor 30 in either positive or opposite direction relative to the stand 10. The table 20 may further include an electric control unit or box or device 60 attached thereto and coupled to the motor 50 for controlling the motor 50, and one or more batteries 52 attached to the table 20 and coupled to the motor 50 and/or the control device 60, for controlling the motor 50 and/or the control device 60.

In operation, as shown in FIGS. 4-5 and 11-12, the user may be supported on the table 20 and/or may have his feet engaged on the foot pedal 33, and/or may have his ankle portions detachably attached to or secured to the extension 28 with the foot retaining device 30. The actuating device 37 or the motor 37 may be used as a rotating or actuating means to move the stem 35 and the foot anchor members 36 toward the fixed foot supports 31 of the extension 28 and to selectively clamp the feet of the user (FIGS. 9-12). The driving device 50 or the motor 50 may be used as a rotating or driving means to rotate the table 20 relative to the lower supporting stand 10, to allow the user to comfortably conduct the tilting inversion exercises.

Figure 6:
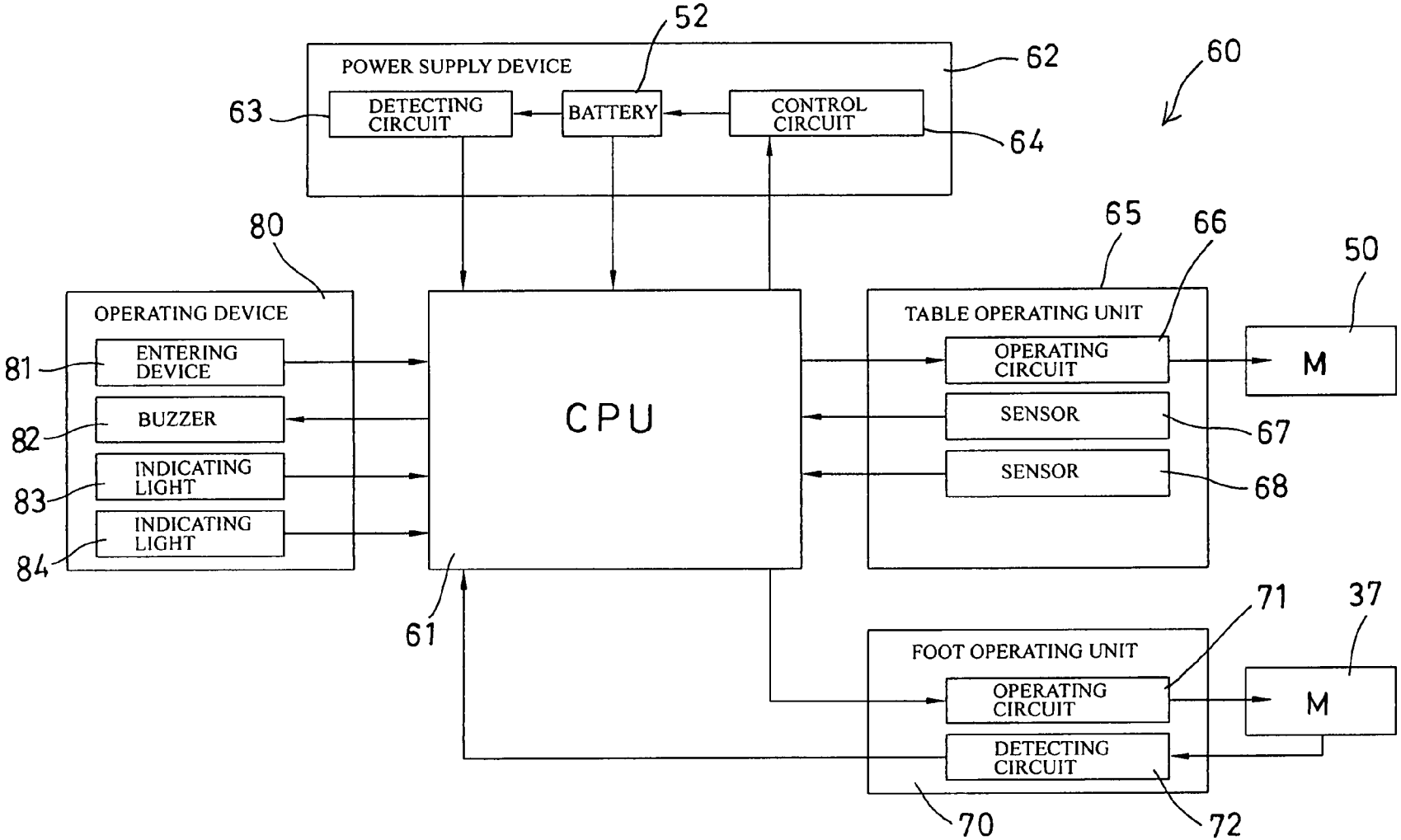
FIG. 6 is a plan schematic view or a block diagram illustrating the control circuit of the tilting inversion exerciser.
Figure 8:
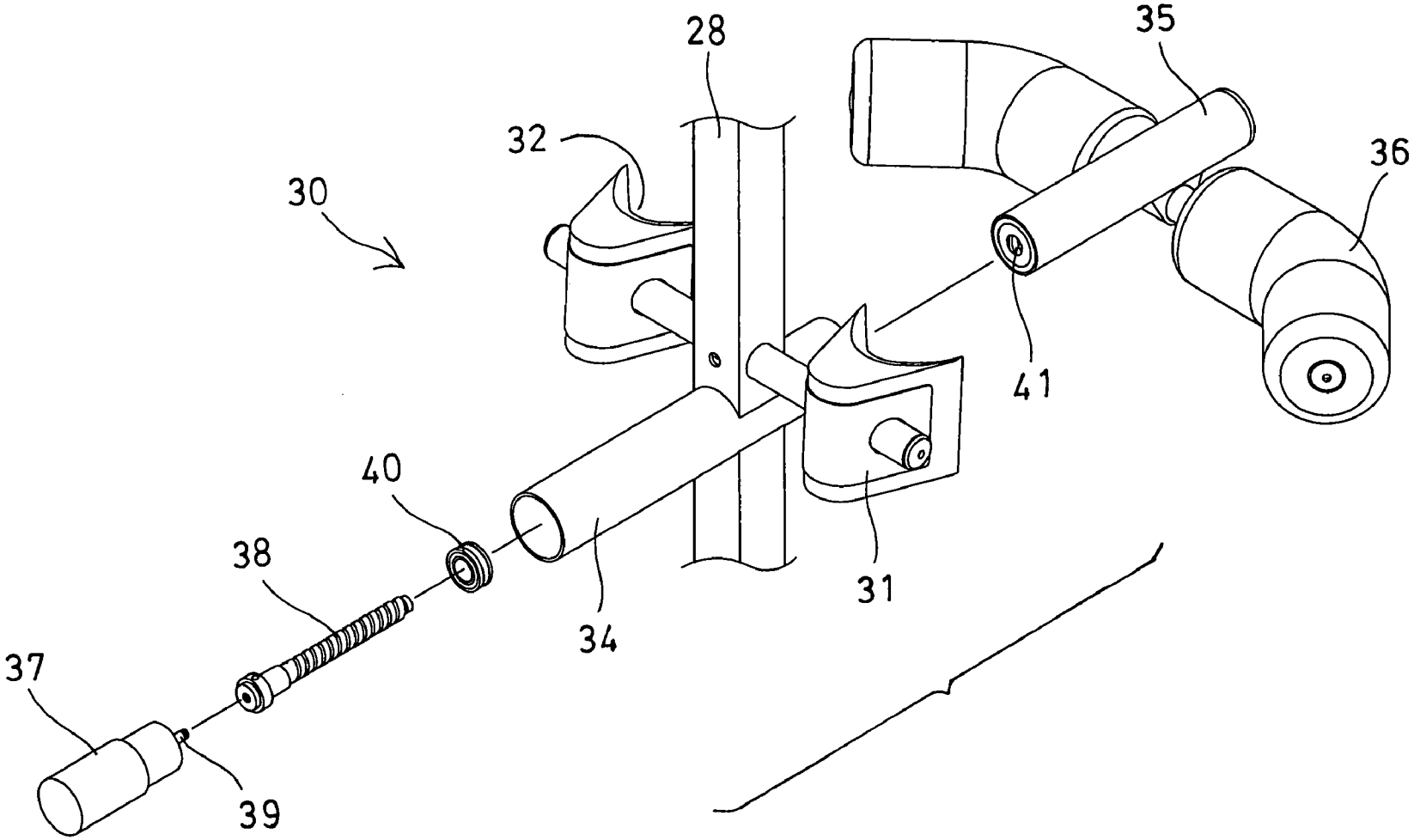
FIG. 8 is a partial exploded view of the tilting inversion exerciser.
Figure 10:
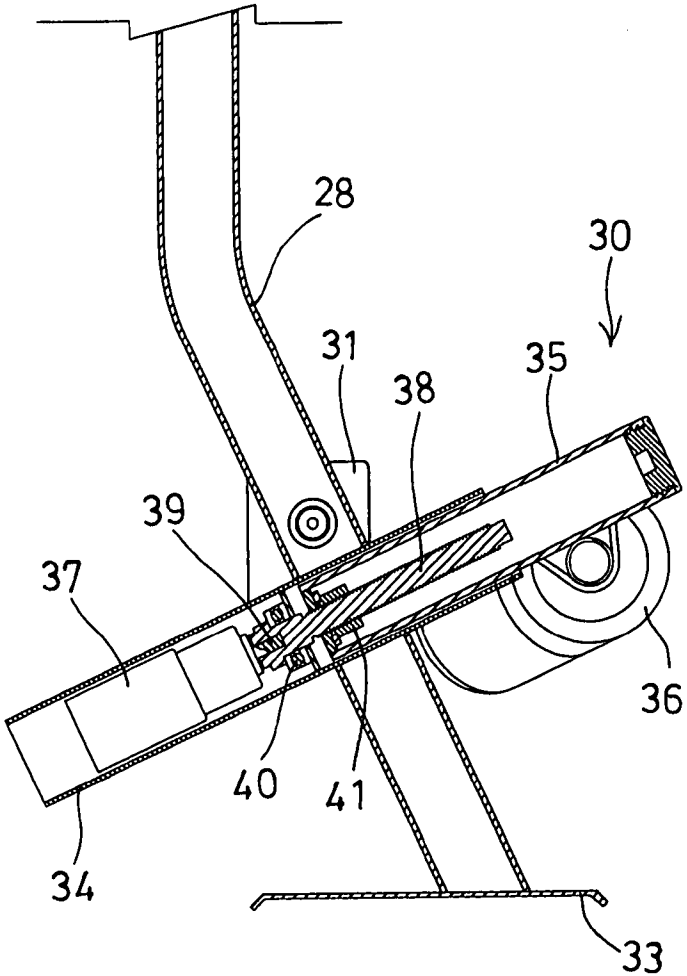
FIG. 10 is a partial cross sectional view similar to FIG. 9, illustrating the operation of the ankle holder device of the tilting inversion exerciser.
Figure 9:
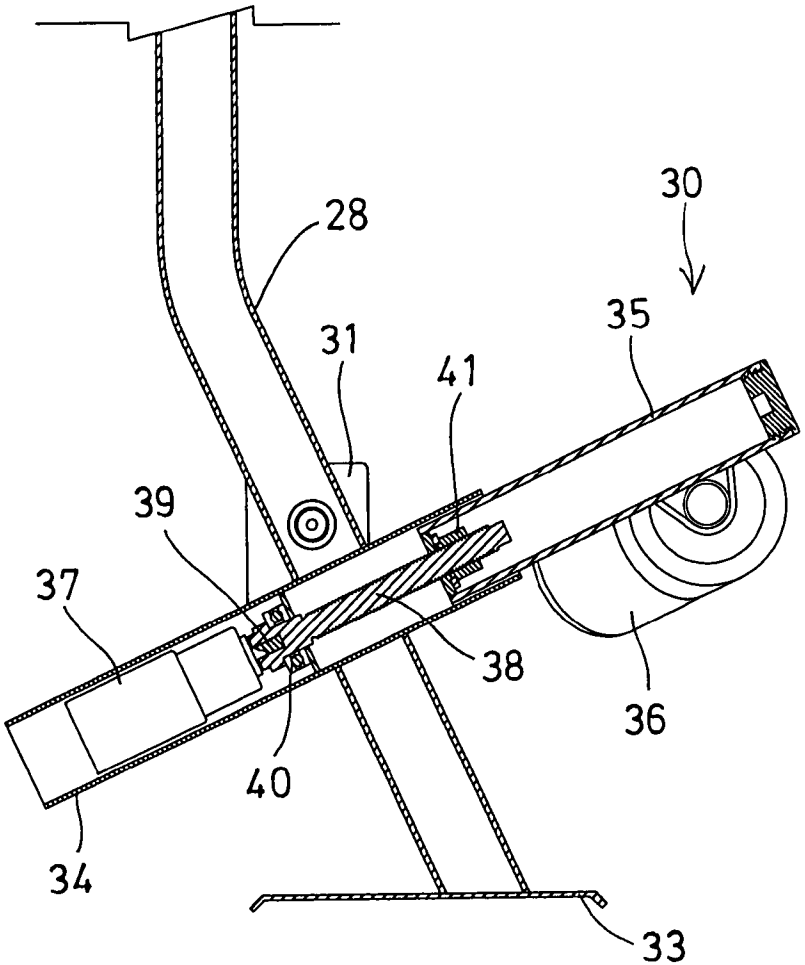
FIG. 9 is a partial cross sectional view of the tilting inversion exerciser, taken along lines 9-9 of FIG. 7.
Figure 11:
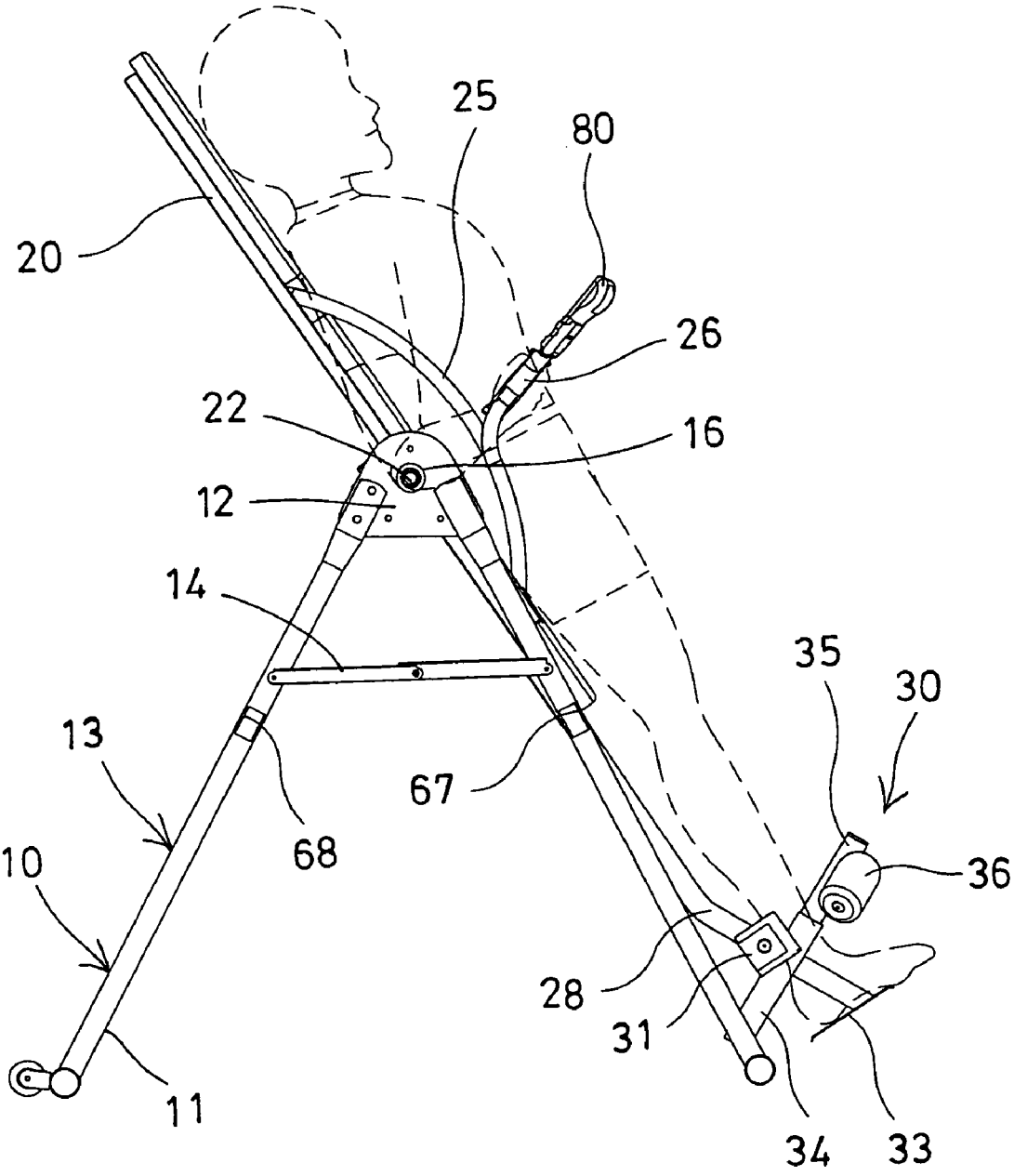
FIG. 11 is a side plan schematic view similar to FIGS. 4 and 5, illustrating the operation of the ankle holder device of the tilting inversion exerciser.
Figure 12:
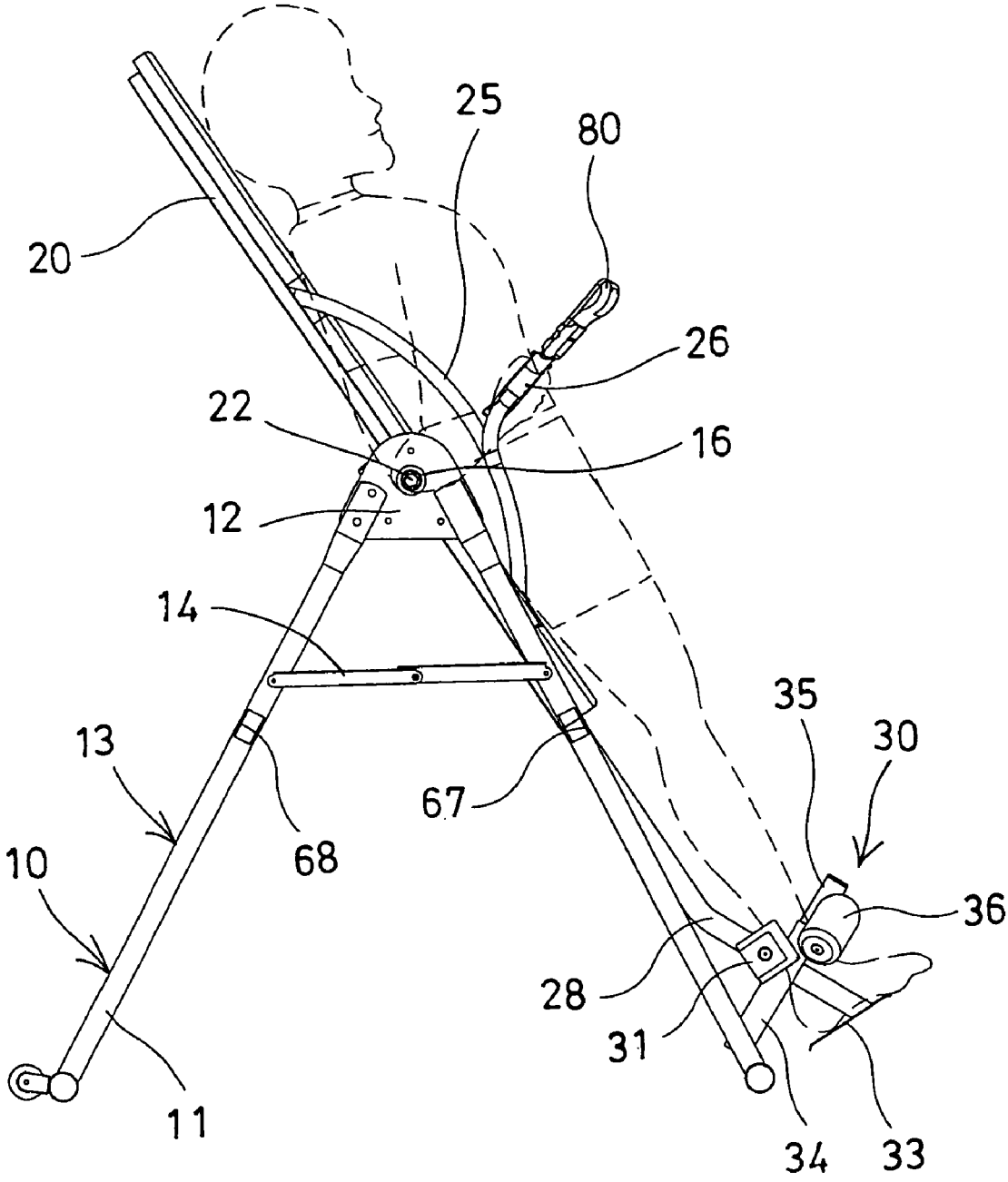
FIG. 12 is a side plan schematic view similar to FIG. 11, illustrating the operation of the ankle holder device of the tilting inversion exerciser.

As shown in FIG. 6, the control device 60 includes a processor device or central processor unit 61, and a power supply device 62 coupled to the central processor unit 61 and coupled to the battery 52. For example, the power supply device 62 includes an electric voltage detecting circuit 63 coupled to the battery 52 for detecting whether the voltage of the battery 52 is good enough to energize or actuate the motors 37, 50 or not, and includes a control circuit 64 coupled to the battery 52 for controlling the battery 52 to selectively energize or actuate the motors 37, 50. The control circuit 64 may also be coupled to the other electric power sources of such as that in family housings or other buildings or transporting vehicles, for selectively charging the battery 52.

It is preferable that the charging to the battery 52 may be controlled and switched off or stopped by the control circuit 64 when either or both of the motors 37, 50 are energized or actuated or when the table 20 has been moved away from the safety and upwardly extending position, for allowing the battery 52 to be safely charged. The control device 60 further includes a table operating unit 65 having an operating circuit 66 coupled to the central processor unit 61 and coupled to the motor 50 for controlling or operating the motor 50 to rotate the table 20 relative to the lower supporting stand 10.

The table operating unit 65 of the control device 60 further includes two detecting members or microswitches or sensors 67, 68 attached to such as the legs 11 of the lower supporting stand 10 for detecting or sensing the position of the table 20 and thus for controlling the rotational movement of the table 20 relative to the lower supporting stand 10. The control device 60 further includes a foot operating unit 70 having an operating circuit 71 coupled to the central processor unit 61 and coupled to the motor 37 for controlling or operating the motor 37 to move the stem 35 and the foot anchor members 36 toward the fixed foot supports 31 of the extension 28 and to clamp the feet of the user.

The foot operating unit 70 of the control device 60 further includes a detecting circuit 72 coupled to the central processor unit 61 and coupled to the motor 37 for detecting whether the feet of the user has been suitably clamped between the foot anchor members 36 of the stem 35 and the fixed foot supports 31 of the extension 28 or not, and for stopping the motor 37 when the feet of the user has been suitably clamped between the foot anchor members 36 of the stem 35 and the fixed foot supports 31 of the extension 28. The control device 60 further includes an operating device 80 having an entering device 81 coupled to the central processor unit 61 for operating or controlling the control device 60. The entering device 81 may be selected from keyboards, depress buttons, or other keying or entering devices.

The operating device 80 is preferably attached to one of the hand grips 26 for allowing the operating device 80 to be easily and readily operated with the hand of the user that holds the hand grips 26. The operating device 80 of the control device 60 may include one or more buzzers 82 for generating warning sound, and one or more indicating lights 83, 84 for generating warning or indicating lights. For example, when the detecting circuit 72 of the foot operating unit 70 has detected that the feet of the user has been suitably clamped between the foot anchor members 36 of the stem 35 and the fixed foot supports 31 of the extension 28, one of the indicating lights 83 may be energized to generate indicating light and to show that the feet of the user has been suitably or safely clamped or retained in place.

When the electric power or the voltage in the batteries 52 is short or is not enough to energize or actuate the motors 37, 50, the buzzer 82 may be energized to generate warning sound and to warn the user that the electric power is short and that the batteries 52 are required to be changed or replaced. The other indicating light 84 may also be energized to generate indicating light and to show that the electric power is short. At this moment, the central processor unit 61 may actuate the operating circuit 66 to operate the motor 50 and to forcefully rotate the table 20 rotated back to the original position, for preventing the user from being suspended upon the supporting stand 10 and for allowing the user to safely get off the table 20.

It is preferable that the entering device 81 of the operating device 80 further includes an emergency button (not shown) for actuating the central processor unit 61 to force the operating circuit 66 to operate the motor 50 and to forcefully rotate the table 20 rotated back to the original position from wherever the table 20 is located or positioned, and thus for allowing the user to safely get off the table 20. It is to be noted that the typical tilting inversion exercisers failed to provide a power rotating or actuating ankle holder or foot retaining means or device for detachably securing or retaining the ankle portions of the user to the table of the tilting inversion exerciser.

Accordingly, the tilting inversion exerciser in accordance with the present invention includes a power driving device for driving or rotating the tilting inversion exerciser relative to the supporting stand and for allowing the table to be rotated relative to the lower support to the vertical position relative to the lower support and the ground, and thus for allowing the user to safely conduct the inversion exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tilting inversion exerciser comprising:

a supporting stand, a table rotatably supported on said supporting stand with a pivot axle for supporting a user on said table, and said table including two fixed foot supports for supporting the feet of the user, and a power actuating foot retaining means attached to said table for being powered and actuated to clamp and to retain ankle portions of the user to said table, said power actuating foot retaining means including a tube attached to said table, a stem slidably attached to said tube, two foot anchor members attached to said stem and movable toward and away from said fixed foot supports for clamping and retaining the feet of the user to said table, and means for moving said foot anchor members relative to said fixed foot supports.

2. The tilting inversion exerciser as claimed in claim 1, wherein said moving means includes a threaded shank rotatably disposed in said tube, and a threaded member secured in said stem and threaded with said threaded shank for allowing said threaded member and said stem to be moved and adjusted relative to said tube.

3. The tilting inversion exerciser as claimed in claim 2, wherein said moving means includes a motor coupled to said threaded shank for rotating and driving said threaded shank.

4. The tilting inversion exerciser as claimed in claim 3, wherein said table includes a control device having a central processor unit, and a foot operating unit coupled to said central processor unit and coupled to said motor for operating said motor to move said stem relative to said tube.

5. The tilting inversion exerciser as claimed in claim 4, wherein said foot operating unit includes a detecting circuit coupled to said central processor unit and coupled to said motor for detecting whether the feet of the user have been clamped between said foot anchor members of said stem and said fixed foot supports or not.

6. The tilting inversion exerciser as claimed in claim 1, wherein said foot retaining means includes an extension extended from said table for supporting said tube and said fixed foot supports.

7. The tilting inversion exerciser as claimed in claim 6, wherein said table includes a foot pedal attached to said extension for supporting the feet of the user.

8. The tilting inversion exerciser as claimed in claim 1, wherein said table includes a motor coupled to said pivot axle for rotating said table relative to said supporting stand.

9. A tilting inversion exerciser comprising:

a supporting stand, a table rotatably supported on said supporting stand with a pivot axle for supporting a user on said table, and a power actuating foot retaining means attached to said table for being powered and actuated to clamp and to retain ankle portions of the user to said table, a motor coupled to said pivot axle for rotating said table relative to said supporting stand, and a reduction gearing coupled to said motor and engaged with said pivot axle to drive and to rotate said table relative to said stand with said pivot axle.

10. A tilting inversion exerciser comprising:

a supporting stand, a table rotatably supported on said supporting stand with a pivot axle for supporting a user on said table, and a power actuating foot retaining means attached to said table for being powered and actuated to clamp and to retain ankle portions of the user to said table, a motor coupled to said pivot axle for rotating said table relative to said supporting stand, and a control device having a central processor unit, and a table operating unit coupled to said central processor unit and coupled to said motor for operating said motor to rotate said table relative to said supporting stand.

11. The tilting inversion exerciser as claimed in claim 10, wherein said table operating unit includes an operating circuit coupled to said central processor unit and coupled to said motor.

12. The tilting inversion exerciser as claimed in claim 10, wherein said table operating unit includes at least one sensor for detecting a position of said table.

13. The tilting inversion exerciser as claimed in claim 10, wherein said control device includes an operating device having an entering device coupled to said central processor unit for operating said control device.

14. The tilting inversion exerciser as claimed in claim 13, wherein said operating device includes a buzzer for generating a warning sound.

15. The tilting inversion exerciser as claimed in claim 13, wherein said operating device includes at least one indicating light for generating indicating lights.

16. The tilting inversion exerciser as claimed in claim 13, wherein said table includes at least one hand grip for supporting said operating device.

17. The tilting inversion exerciser as claimed in claim 10, wherein said control device includes a power supply device coupled to said central processor unit.

18. The tilting inversion exerciser as claimed in claim 17, wherein said power supply device includes a battery, and a detecting circuit coupled to said battery for detecting an electric power of said battery.

* * * * *